US009333132B2

(12) United States Patent
Bruestle et al.

(10) Patent No.: US 9,333,132 B2
(45) Date of Patent: May 10, 2016

(54) WHEELCHAIR LIFT SYSTEM AND METHOD

(75) Inventors: Tod A. Bruestle, Prior Lake, MN (US); Donald P. Borchert, Eagan, MN (US)

(73) Assignee: KATEZLIFT, Mendota, MN (US)

( * ) Notice: Subject to any disclaimer, the term of this patent is extended or adjusted under 35 U.S.C. 154(b) by 1096 days.

(21) Appl. No.: 13/304,087

(22) Filed: Nov. 23, 2011

(65) Prior Publication Data

US 2012/0205953 A1 Aug. 16, 2012

Related U.S. Application Data

(60) Provisional application No. 61/458,477, filed on Nov. 24, 2010, provisional application No. 61/549,851, filed on Oct. 21, 2011.

(51) Int. Cl.
*A61G 5/10* (2006.01)

(52) U.S. Cl.
CPC ..... *A61G 5/104* (2013.01); *Y10T 29/49959* (2015.01)

(58) Field of Classification Search
CPC ..... B66F 3/10; B66F 3/28; B66F 7/00
See application file for complete search history.

(56) References Cited

U.S. PATENT DOCUMENTS

| | | | | |
|---|---|---|---|---|
| 3,379,450 | A | 4/1968 | Jones et al. | |
| 3,962,737 | A | 6/1976 | James | |
| 4,079,990 | A | 3/1978 | McMunn et al. | |
| 4,119,342 | A | 10/1978 | Jones | |
| 4,592,695 | A | 6/1986 | McConnell | |
| 4,738,581 | A | 4/1988 | Kuhlman | |
| 4,830,567 | A | 5/1989 | Rachman | |
| 4,934,723 | A | 6/1990 | Dysarz | |
| 4,949,408 | A | 8/1990 | Trkla | |
| 4,997,200 | A | 3/1991 | Earls | |
| 5,050,899 | A | 9/1991 | Stensby | |
| 5,112,076 | A | 5/1992 | Wilson | |
| 5,179,745 | A | 1/1993 | Hebert et al. | |
| 5,292,144 | A | 3/1994 | Sosnoff | |
| 5,333,887 | A | 8/1994 | Luther | |
| 5,520,403 | A | 5/1996 | Bergstrom et al. | |
| 5,601,302 | A | 2/1997 | Beard et al. | |
| 5,613,697 | A | 3/1997 | Johnson | |
| 5,669,620 | A | 9/1997 | Robbins | |
| 6,015,256 | A | 1/2000 | Mesa et al. | |
| 6,203,044 | B1 | 3/2001 | Conaway et al. | |
| 6,247,718 | B1 * | 6/2001 | Gobbers et al. | 280/304.1 |
| 6,257,552 | B1 * | 7/2001 | Crow | B66F 3/24 254/134 |
| 6,478,529 | B1 | 11/2002 | Willey et al. | |
| 6,499,163 | B1 | 12/2002 | Stensby | |
| 6,565,112 | B2 | 5/2003 | Hanson et al. | |
| 6,641,354 | B1 | 11/2003 | Lubrano et al. | |

(Continued)

FOREIGN PATENT DOCUMENTS

| | | | |
|---|---|---|---|
| EP | 1205172 | A2 | 5/2002 |
| WO | 2008/148922 | A1 | 12/2008 |

OTHER PUBLICATIONS

PCT/US2011/062051, International Search Report and Written Opinion dated Apr. 5, 2012, 9 pages.

*Primary Examiner* — Lee D Wilson
(74) *Attorney, Agent, or Firm* — Fredrikson & Byron, P.A.

(57) ABSTRACT

A wheelchair lift system that allows a wheelchair and a person sitting in the wheelchair to be selectively positioned at a standing height or a sitting height. A lift system that is attachable to wide variety of existing wheelchairs.

17 Claims, 21 Drawing Sheets

(56) References Cited

U.S. PATENT DOCUMENTS

| | | | | |
|---|---|---|---|---|
| 6,851,751 | B1 | 2/2005 | Romero et al. | |
| 7,055,840 | B1 | 6/2006 | Kelso | |
| 7,090,241 | B2 | 8/2006 | Silva | |
| 7,144,026 | B2 | 12/2006 | Kao | |
| 7,303,181 | B1 * | 12/2007 | Nymann | 254/8 R |
| 7,512,998 | B2 | 4/2009 | Martin et al. | |
| 7,549,703 | B2 | 6/2009 | McElhinney | |
| 7,661,696 | B1 | 2/2010 | Acebo | |
| 7,665,166 | B2 | 2/2010 | Martin et al. | |
| 7,774,873 | B2 | 8/2010 | Martin et al. | |
| 7,845,665 | B2 | 12/2010 | Borisoff | |
| 8,007,220 | B2 | 8/2011 | Vandyke et al. | |
| 2003/0205883 | A1 | 11/2003 | Bergstrom et al. | |
| 2007/0227787 | A1 | 10/2007 | Kuramoto | |
| 2008/0272351 | A1 * | 11/2008 | Bhachu et al. | 254/93 R |
| 2012/0205953 | A1 * | 8/2012 | Bruestle et al. | 297/344.12 |
| 2013/0313498 | A1 * | 11/2013 | Polins | B66B 9/16<br>254/93 R |

* cited by examiner

WHEELCHAIR LIFT SYSTEM AND METHOD

RELATED APPLICATIONS

This application claims priority to U.S. Provisional Application Ser. No. 61/458,477, titled Wheelchair Lift Attachment, filed Nov. 24, 2010, and U.S. Provisional Application Ser. No. 61/549,851, titled Wheelchair Lift System and Method, filed Oct. 21, 2011, the contents of both of which are hereby incorporated by reference.

FIELD OF THE INVENTION

The invention generally relates to lift systems for wheelchairs.

BACKGROUND OF THE INVENTION

Wheelchairs are useful for allowing individuals with disabilities to be mobile. Unfortunately, traditional wheelchairs do not allow the individual to experience everyday life at a traditional standing or sitting height when the wheelchair is not being used to change location. Wheelchairs that are articulatable between a sitting orientation and a standing orientation have been described. However, these wheelchairs are typically constructed such that a frame of the wheelchair itself is integrated into a lift system that allows for the height adjustment. Accordingly, these are specialized wheelchairs and the lift system cannot attach to an existing wheelchair already owned by the individual or moved between several wheelchairs owned by an individual. Further, many of these wheelchairs require the individual to first orientate foot support members on the underside of the chair to provide for greater stability in the standing orientation. Making such adjustments are difficult and uncomfortable for an individual sitting in the wheelchair.

SUMMARY OF THE INVENTION

Embodiments of the invention include a wheelchair lift system. Such a lift system is useful for attaching to a wide variety of existing wheelchairs to provide an individual confined to the wheelchair a selectable option of resting at a sitting height, resting at a standing height, or at any of an infinite number of heights between the maximum standing height provided by the lift system and the minimum sitting height provided by the lift system. In some embodiments, the lift system moves the entire chair, including the frame and wheels, with respect to the floor. Further, in some embodiments, lower support members adapted to provide stability to the wheelchair when it is in the standing position are retractable above the floor when the wheelchair is in the sitting position. In certain embodiments, the orientation (e.g., angle) of the support members does not change with respect to the wheelchair frame when the wheelchair is in the standing position or the sitting position. In some embodiments, the lift system includes a universal attachment mechanism that allows the lift system to be attachable to a wide variety of existing wheelchairs. Accordingly, embodiments of the invention allow an individual confined to a wheelchair to easily position a wide variety of wheelchairs in a standing position, a sitting position, and any desired position between the standing and sitting positions.

BRIEF DESCRIPTION OF THE DRAWING

The following drawings are illustrative of particular embodiments of the invention and therefore do not limit the scope of the invention. The drawings are not necessarily to scale (unless so stated) and are intended for use in conjunction with the explanations in the following detailed description. Embodiments of the invention will hereinafter be described in conjunction with the appended drawings, wherein like numerals denote like elements.

DETAILED DESCRIPTION OF THE INVENTION

Figure 1:
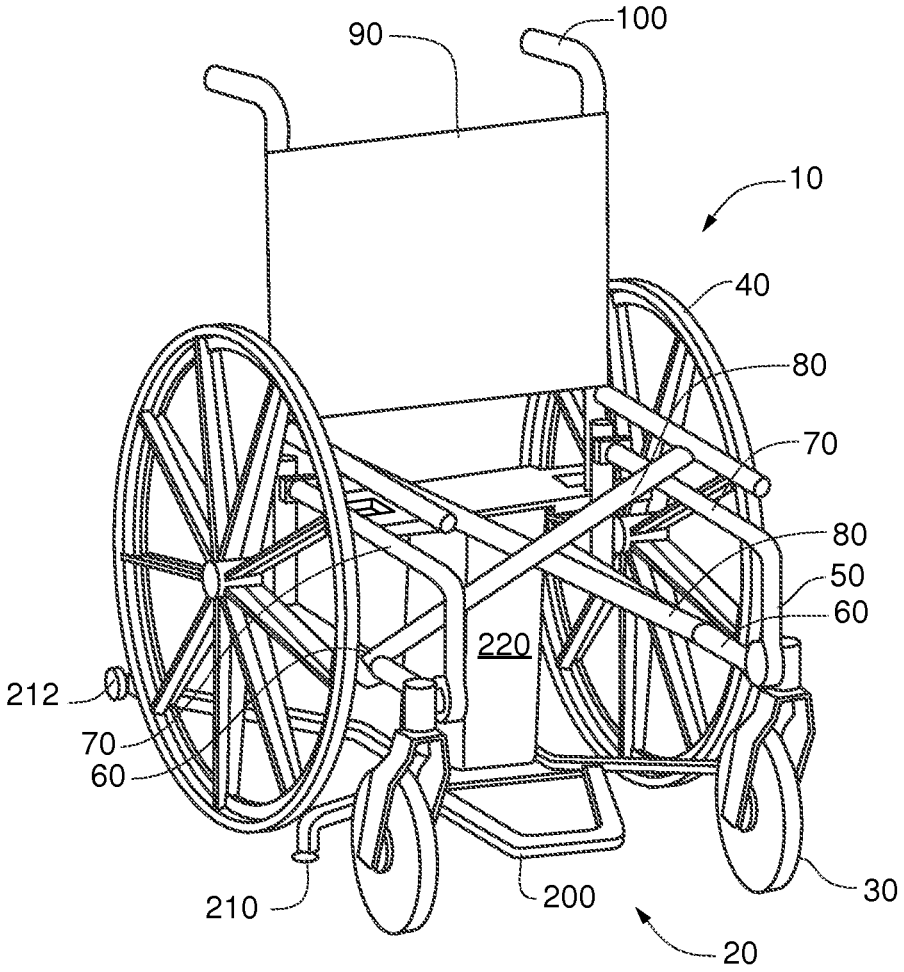
FIG. 1 shows a front perspective view of a wheelchair and lift system in a sitting position in accordance with an embodiment of the invention.

For the purpose of promoting an understanding of the principles of the invention, reference will now be made to the embodiments illustrated in the drawing and specific language will be used to describe the same. It will, nevertheless, be understood that no limitation of the scope of the invention is thereby intended; any alterations and further modifications of the described or illustrated embodiments, and any further applications of the principles of the invention as illustrated therein, are contemplated as would normally occur to one skilled in the art to which the invention relates. It should be noted that all references to vertical, horizontal, above, below, front, rear, left, right and the like are terms of convenience referring to the chair as positioned in a seating configuration.

Embodiments of the invention include a lift system for a wheelchair that allows the wheelchair to be selectively positioned in a standing position, a sitting position, or any position between the standing position and the sitting position. By "standing position," it is meant that a person sitting in the wheelchair will be elevated so that the person's head is generally at a standing height. By "sitting position," it is meant that a person sitting in the wheelchair will be elevated so that the person's head is generally at a sitting height.

Figure 2:
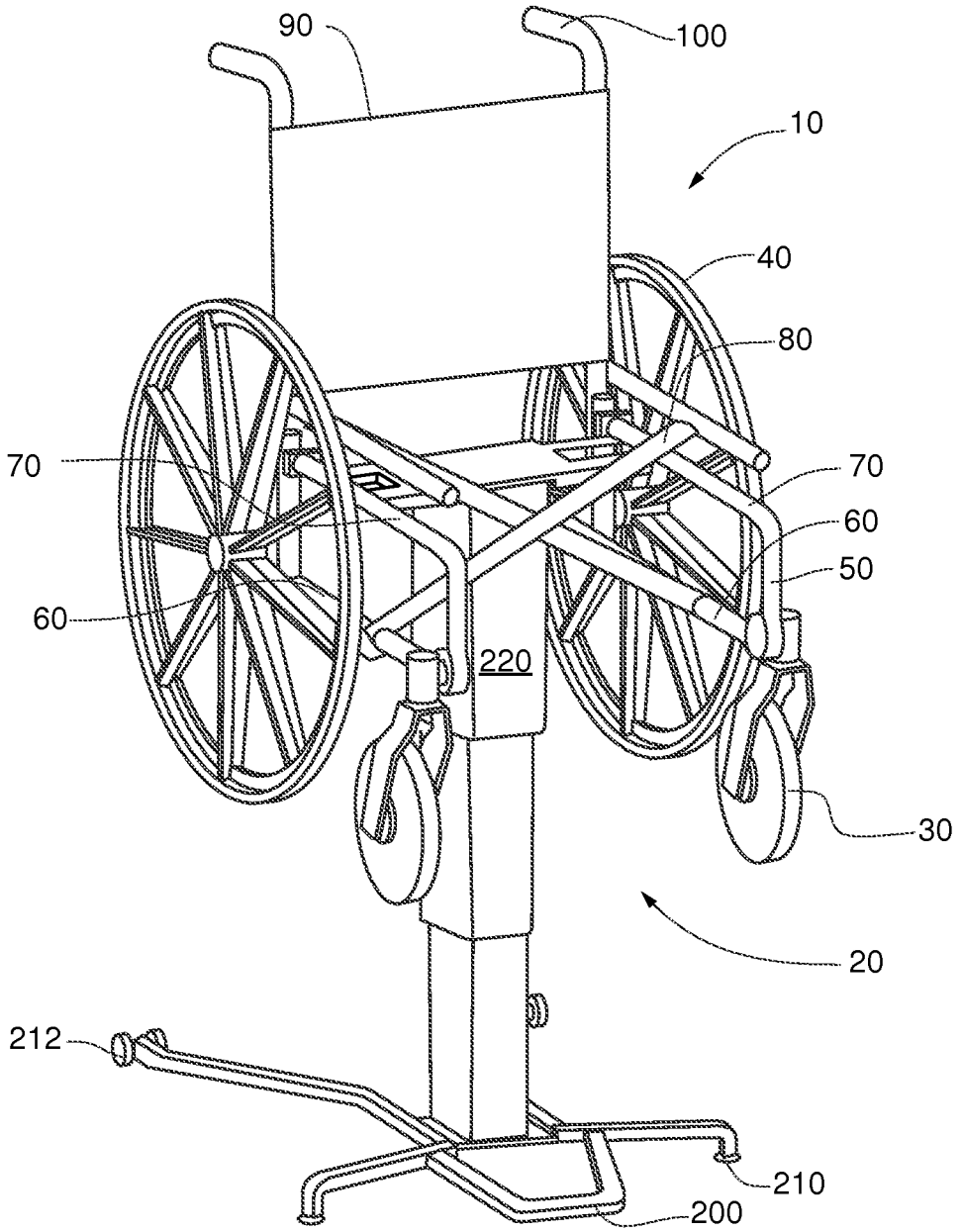
FIG. 2 shows a front perspective view of the wheelchair and lift system of FIG. 1 in a standing position in accordance with an embodiment of the invention.

FIG. 1 shows a front perspective view of a wheelchair 10 and lift system 20 in a sitting position in accordance with an embodiment of the invention, while FIG. 2 shows the wheelchair and lift system of FIG. 1 in a standing position. As shown, a typical wheelchair includes front wheels 30 and back wheels 40 connected to a frame 50. In the embodiment shown, each side of the frame includes a lower frame rail 60 and an upper frame rail 70. As shown, one or more cross supports 80 connect the upper and lower frame rail members. A generally horizontal planar seat, not shown, is generally positioned above the cross supports, and a generally vertical planar back 90 is provided. In some embodiments, handles 100 are provided proximate the back.

In the embodiment shown, the lift system 20 includes a support frame 200 (sometimes referred to as horizontal support members). The support frame is retractable above the floor (or the plane defined by the bottom of the wheels) so that the wheelchair 10 may be wheeled about with the lift system attached. The support frame also stably supports the lift system, wheelchair, and an individual in the wheelchair at any raised vertical position up to an including the maximum raised vertical positioned provided by the chair. In some embodiments, the support frame may be provided in different widths to accommodate different widths of various wheelchairs. Further, in some embodiments, the support frame is provided in the same orientation with respect to the chair in both the sitting and standing positions, such that no adjustments to it are required when going back and forth between positions. As shown, front and rear castors 210, 212 may be connected to the support frame. Also as shown, front castors 210 can be positioned between the wheelchair's front wheels 30 and back wheels 40. Further, front castors can extend to or past a generally vertical plane defined by the back wheel. Such an embodiment provides for increased stability in the standing position. Also as shown, rear castors can include wheels. Such wheels are useful for continued motion while tipping back to traverse obstacles while moving the seating position.

The lift system 20 also includes at least one height-adjustable vertically extending vertical frame member 220. In the embodiment shown, a single vertical frame member is provided proximate the center of the wheelchair 10. As shown best in FIG. 3, the vertical frame member 220 includes a first component 214 and a second component 215. The first and second components can be moved linearly with respect to each other. First and second components can be sized such that one component can be received within the other component. In some embodiments, such as with telescoping vertical members, a plurality of components can be provided, and each component can be moved linearly with respect to at least one other component. In certain embodiments, the vertical frame member allows for between about 10 inches and about 30 inches (e.g., about 20 inches) of vertical height adjustment. In some embodiments, the use of a single vertical frame member reduces the propensity of binding during height adjustments caused by using multiple frame members and lifting members. Further, when the single vertical member is provided about the center of the wheelchair, folding wheelchairs may be folded at least until they contact the vertical member.

Figure 3:
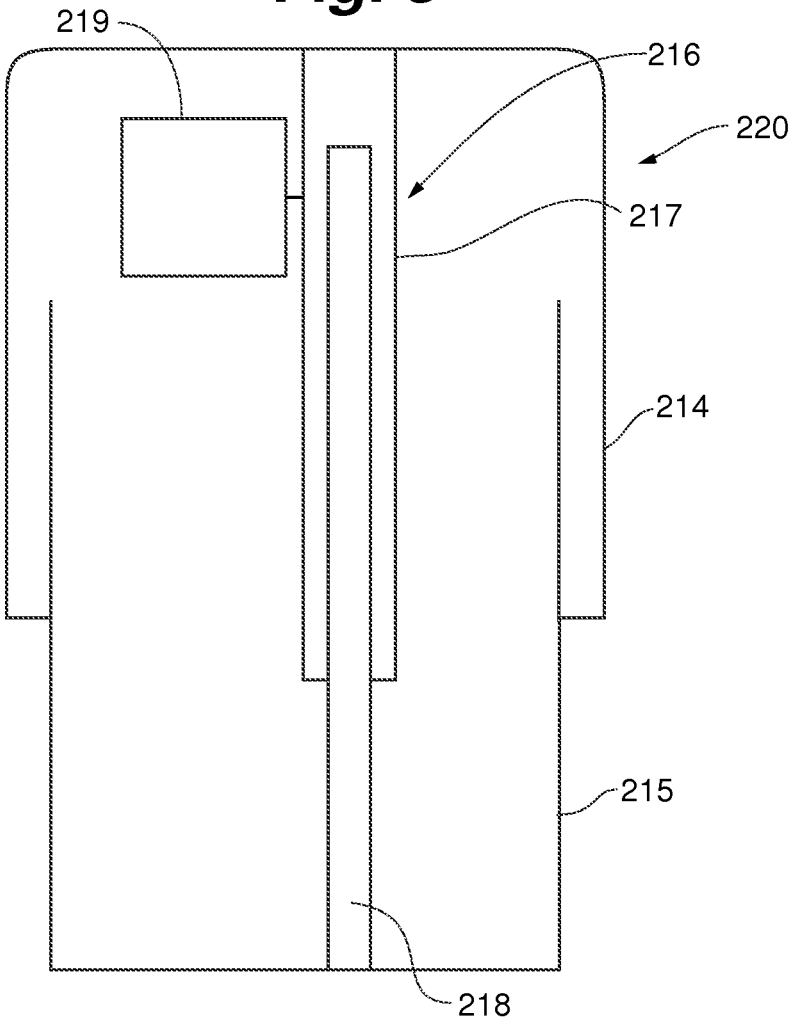
FIG. 3 shows a schematic section view of a vertical member and associated lifting member in accordance with an embodiment of the invention.

The vertical frame member shown in FIG. 3 is telescoping and can include a cavity that houses at least one lifting member 216. Of course, lifting member does not have to be disposed within the vertical frame member, and other embodiments are discussed below that include lifting members disposed adjacent of associated vertical frame members. The lifting member provides a lifting force to extend or retract vertical frame member 220 to move the lift system 20, and a wheelchair 10 to which the lift system is attached, between the standing and sitting positions. In some embodiments the lifting member includes a first component 217 and a second component 218, and the first and second components can be moved with respect to each other. In certain embodiments, one of the first or second components include a male member of a screw gear drive mechanism, and the other of the first and second components includes a female member of a screw gear drive mechanism. In such embodiments, when either of the first or second components is rotated with respect to each other, the rotational movement is translated into vertical movement via the screw drive mechanism. In other embodiments, the lifting member includes an expandable and retractable hydraulic or pneumatic cylinder capable of expanding and retracting the vertical frame member. In some embodiments, the use of a single lifting member (e.g., associated with a single vertical member) reduces the propensity of binding during height adjustments caused by using multiple lifting members.

In some embodiments, as shown in FIG. 3, an actuator 219 is provided to actuate the lifting member 216. In certain embodiments, the actuator includes an electric motor. Such a motor can be used to rotate the screw drive mechanism discussed above to extend or retract the lifting member and a vertical frame member to which it is associated. In other embodiments, the actuator includes a pump to actuate hydraulic or pneumatic lifting members. In any embodiment, the actuator selectively actuated by a switch and may be powered by any suitable power source, such as a battery.

Figure 4:
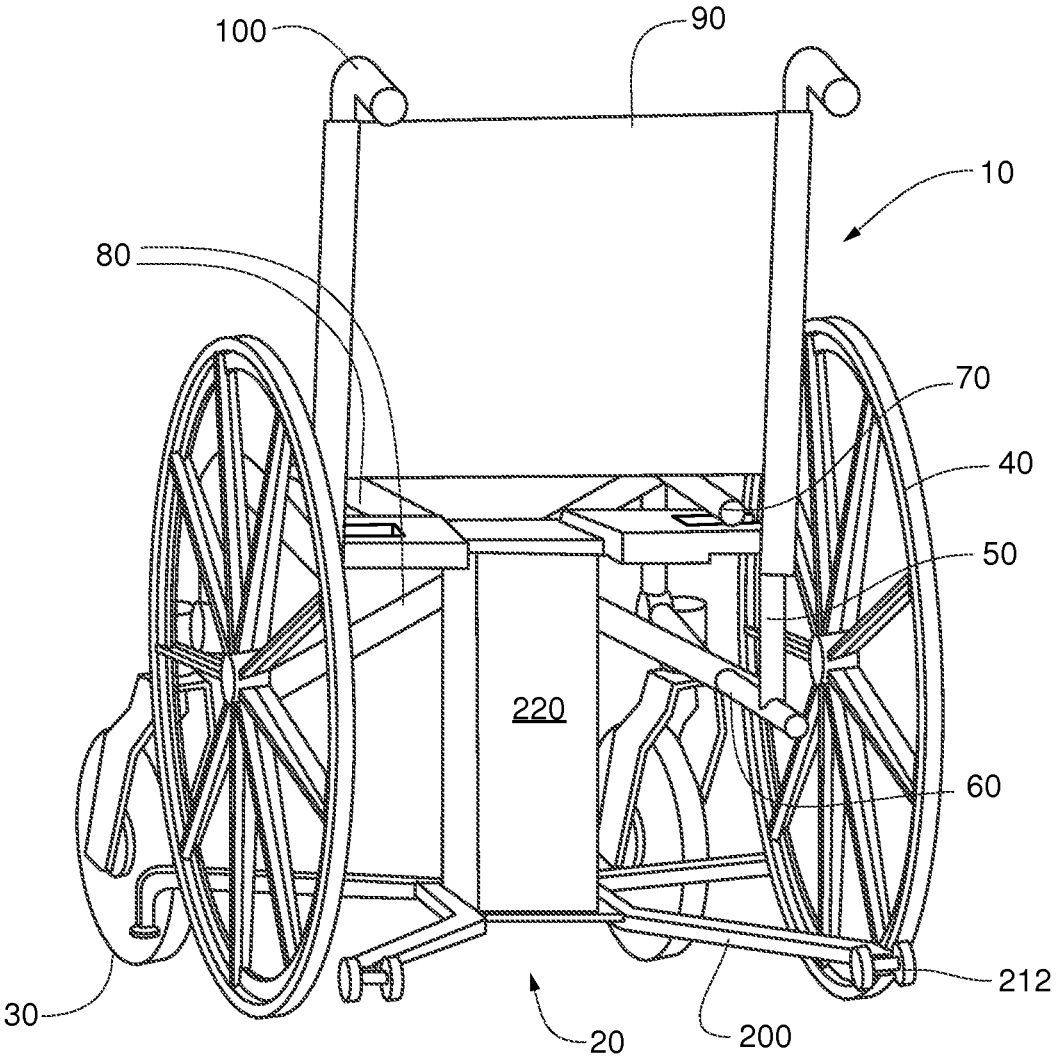
FIG. 4 shows a rear perspective view of a wheelchair and lift system in a sitting position in accordance with an embodiment of the invention.

Various views of an exemplary lift system 20 and wheelchair 10 are shown in FIGS. 4-9. FIG. 4 shows a rear perspective view of a wheelchair 10 and lift system 20 in a sitting position in accordance with an embodiment of the invention.

Figure 5:
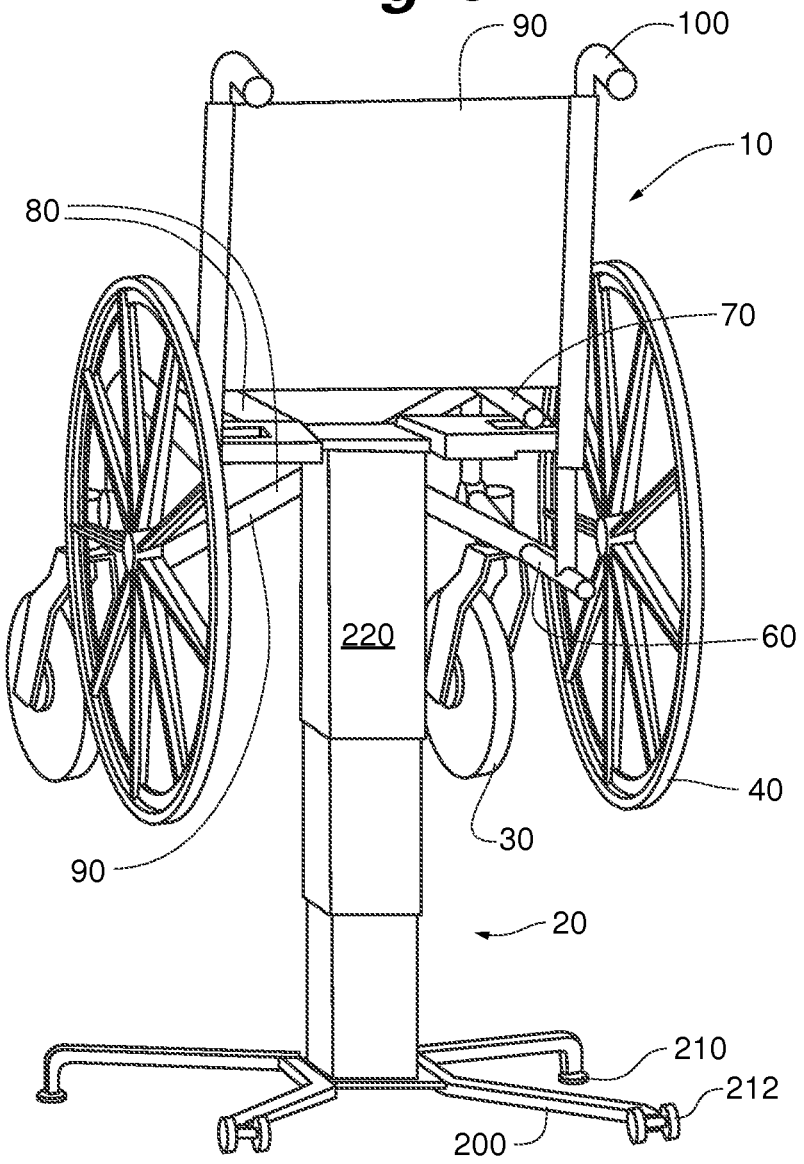
FIG. 5 shows a rear perspective view of the wheelchair and lift system of FIG. 4 in a standing position in accordance with an embodiment of the invention.
Figure 6:
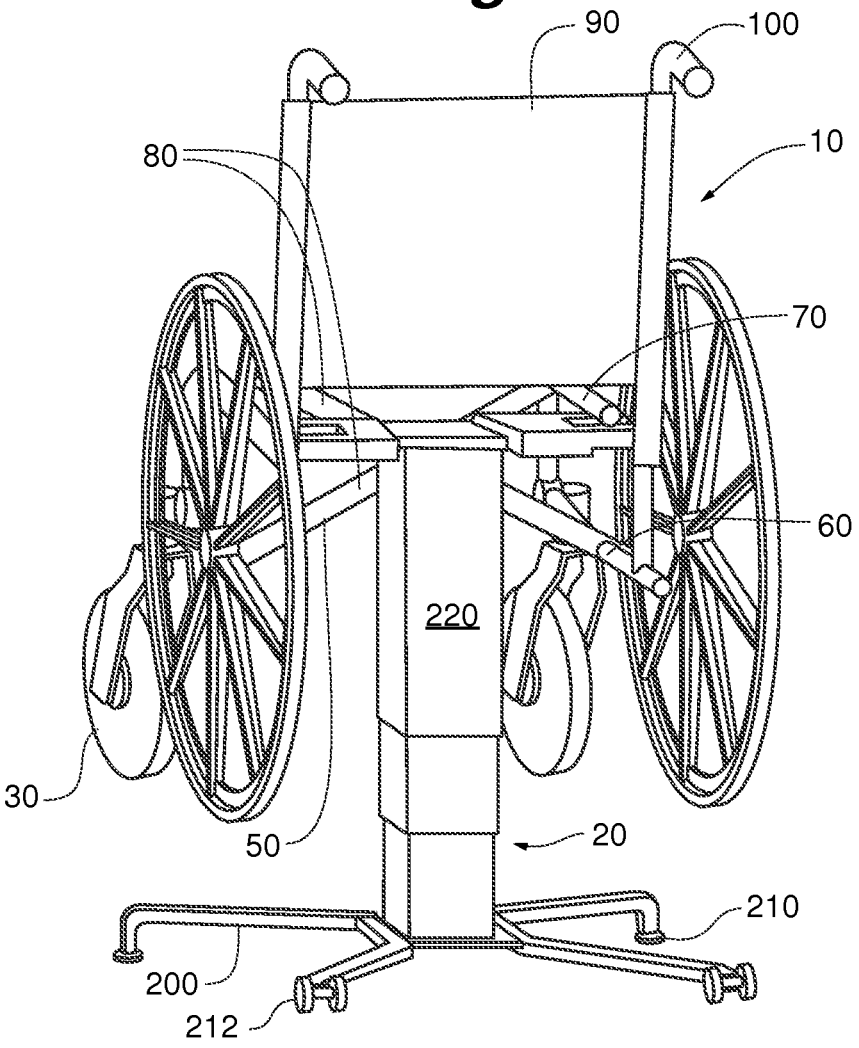
FIG. 6 shows a rear perspective view of the wheelchair and lift system of FIGS. 4 and 5 in an intermediate position between the sitting position of FIG. 4 and the standing position of FIG. 5, in accordance with an embodiment of the invention.
Figure 7:
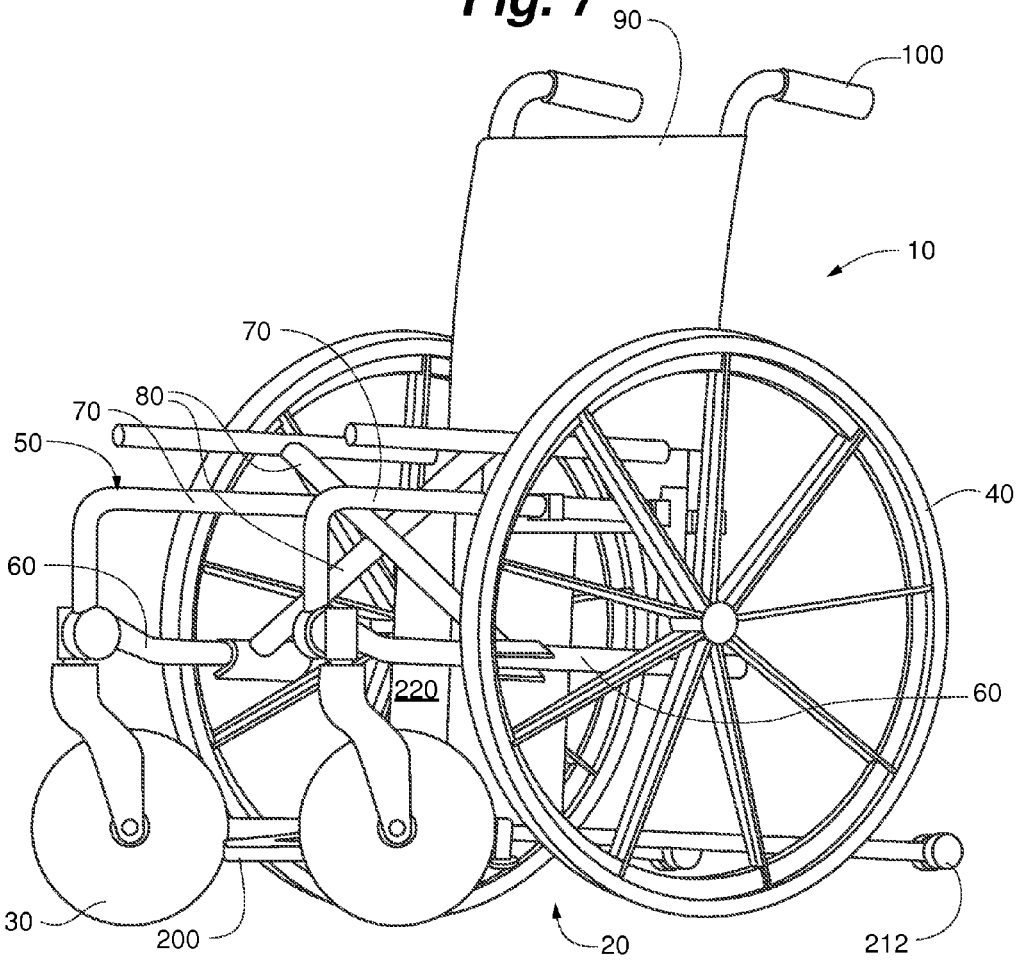
FIG. 7 shows a side perspective view of a wheelchair and lift system in a sitting position in accordance with an embodiment of the invention.
Figure 8:
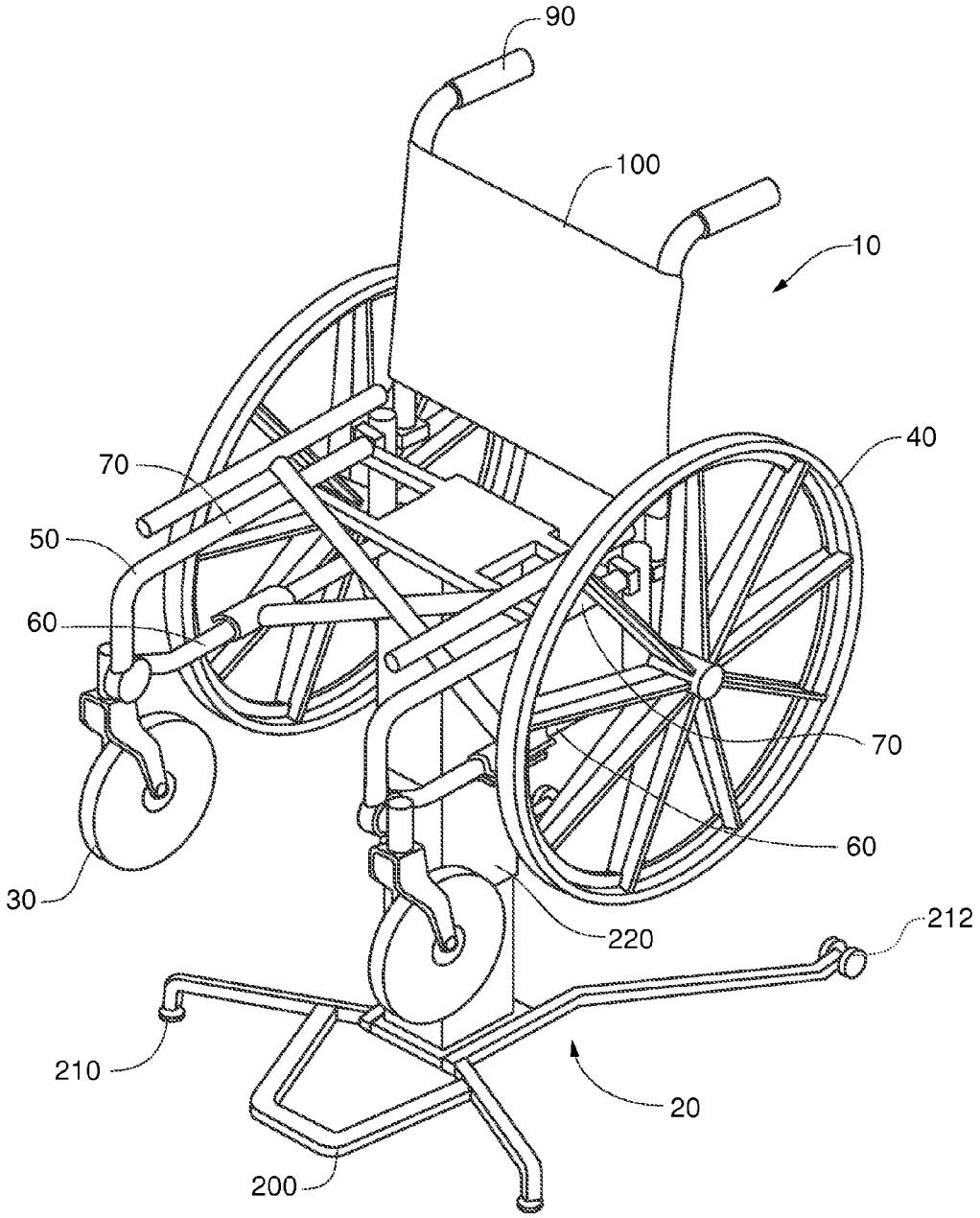
FIG. 8 shows a side perspective view of the wheelchair and lift system of FIG. 7 in a standing position in accordance with an embodiment of the invention.
Figure 9:
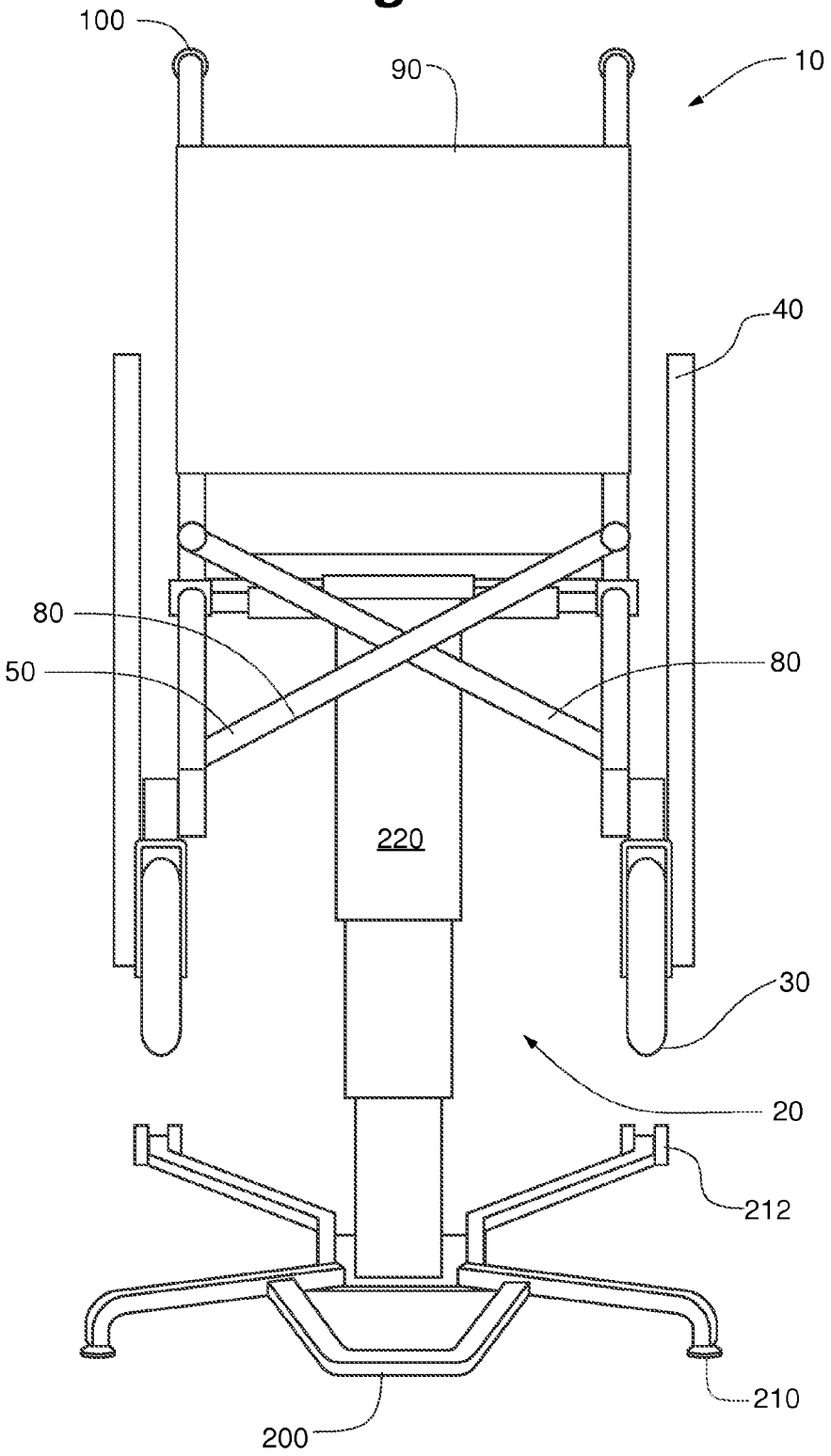
FIG. 9 shows a front perspective view of a wheelchair and lift system in a standing position in accordance with an embodiment of the invention.

FIG. 5 shows a rear perspective view of the wheelchair and lift system in a standing position. FIG. 6 shows a rear perspective view of the wheelchair and lift system in an intermediate position between the sitting position shown in FIG. 4 and the standing position shown in FIG. 5. In some embodiments, the lift system allows a user to select any of an infinite number of vertical height positions between the lowest position allowed by the system and the highest position allowed by the system. FIG. 7 shows a side perspective view of a wheelchair 10 and lift system 20 in a sitting position in accordance with an embodiment of the invention, and FIG. 8 shows a side perspective view of the wheelchair and lift system in a standing position. Finally, FIG. 9 shows a front perspective view of a wheelchair 10 and lift system 20 in a standing position in accordance with an embodiment of the invention.

Figure 10:
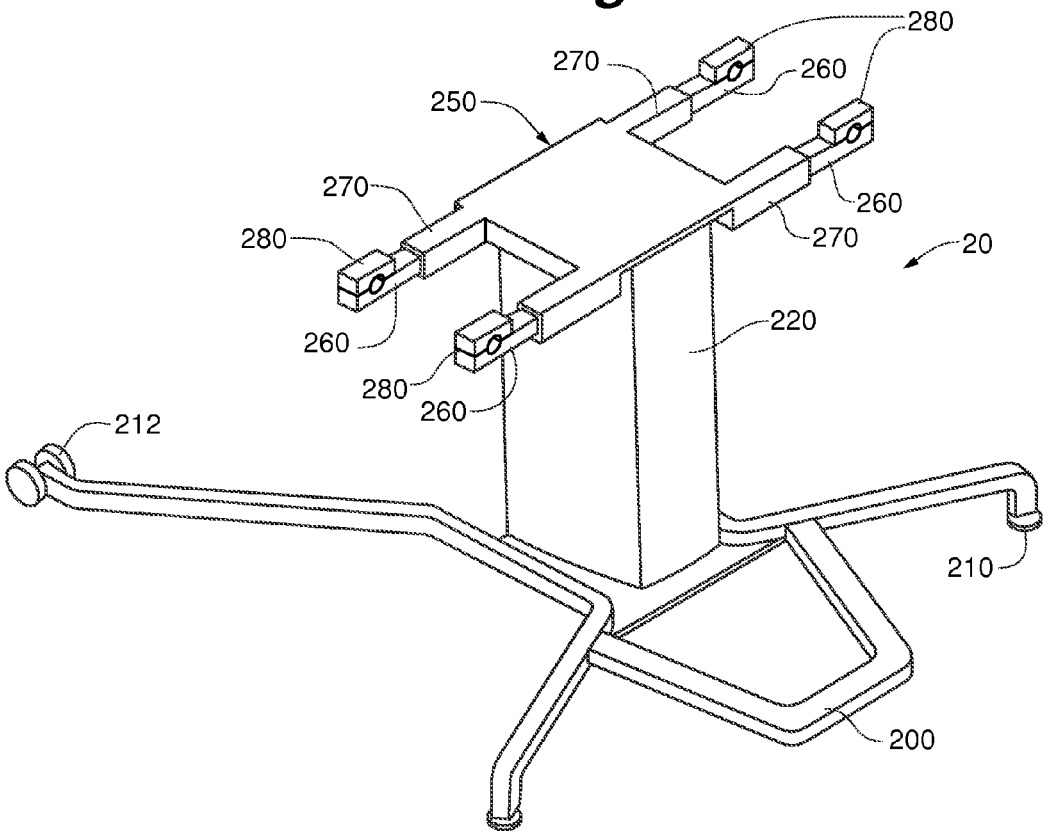
FIG. 10 shows a front perspective view of a wheelchair lift system in accordance with an embodiment of the invention.

As shown in FIG. 10, some embodiments of the lift system 20 also include a universal attachment mechanism 250, e.g., proximate the top of the vertical frame member 220. The universal attachment mechanism allows the lift system to be attached to a wide variety of existing wheelchairs. In some embodiments, the universal attachment mechanism includes one or more (e.g., 2) horizontally extending members 260 received within member receivers 270 on both a left and right hand side. The horizontally extending members are horizontally adjustable so as to accommodate a variety of existing wheelchair sizes and styles. In some embodiments, clamping members 280 are provided at the distal end of each horizontally extending member. In certain embodiments, these clamping members are adapted to attach to an upper or lower frame rail of a wheelchair. As shown, the universal attachment mechanism may be the only non-electrical connection between the lift system 20 and the wheelchair 10. Such embodiments are useful for quickly attaching the lift system 20 to an existing wheelchair.

Figure 11:
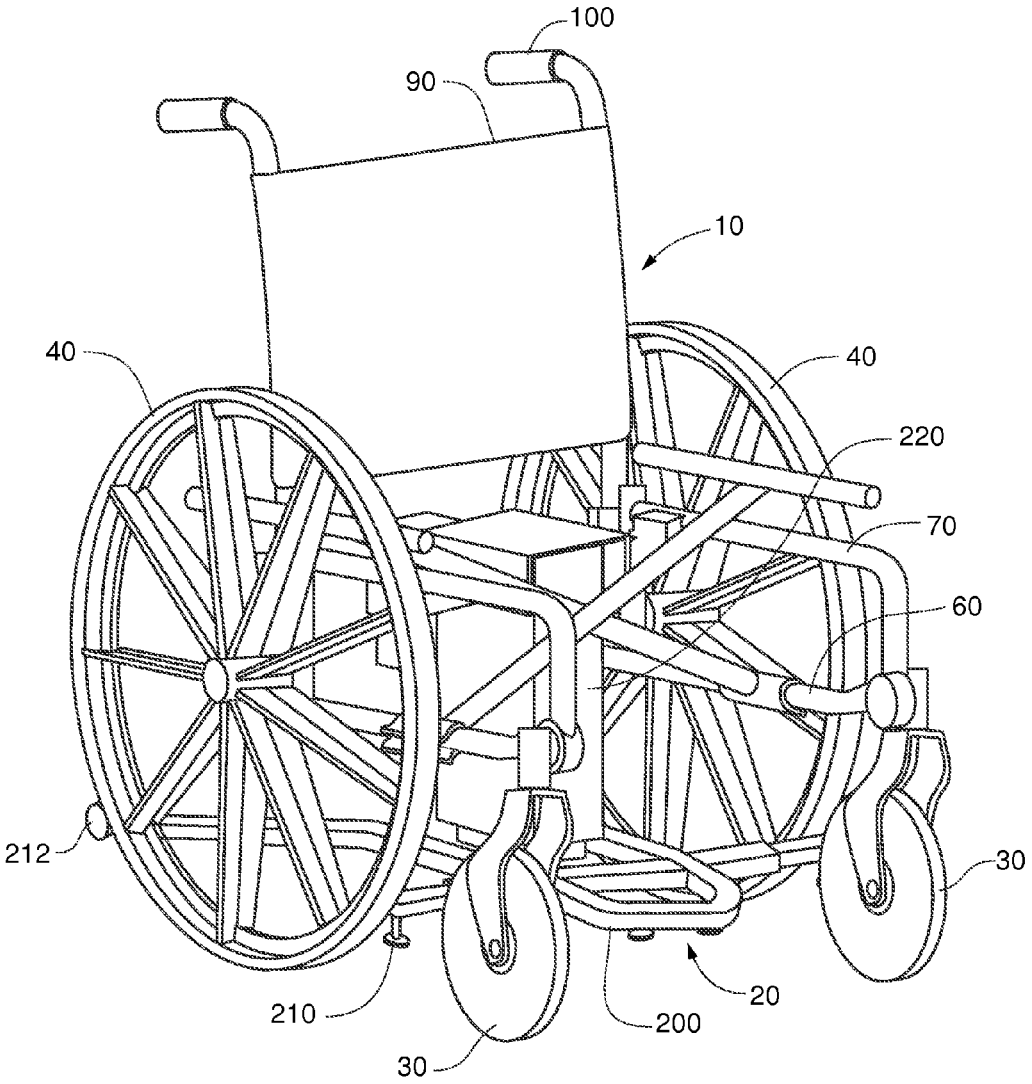
FIG. 11 shows a front perspective view of a wheelchair and a second embodiment of a lift system in a sitting position in accordance with an embodiment of the invention.
Figure 12:
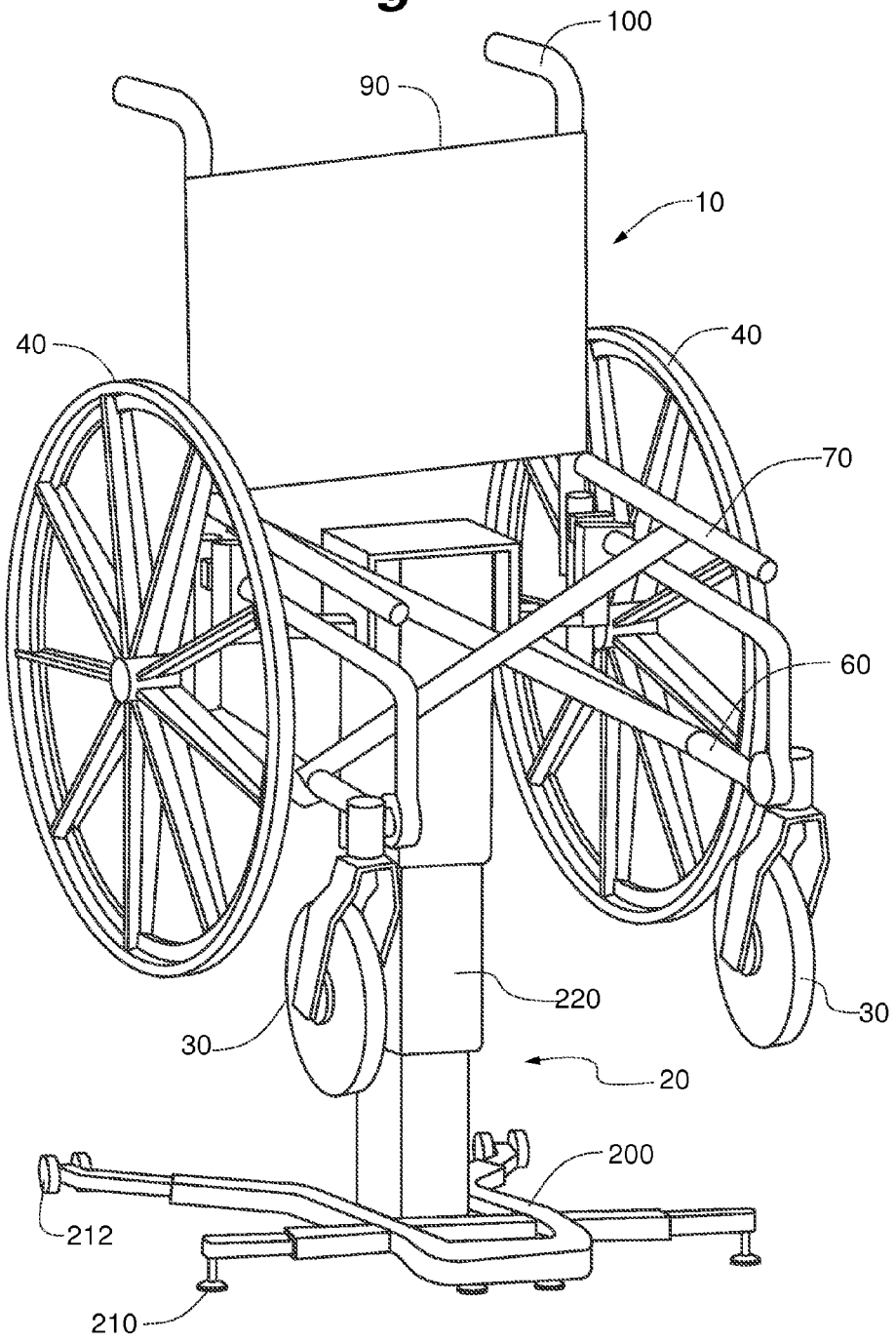
FIG. 12 shows a front perspective view of the wheelchair and lift system of FIG. 11 in a standing position in accordance with an embodiment of the invention.
Figure 13:
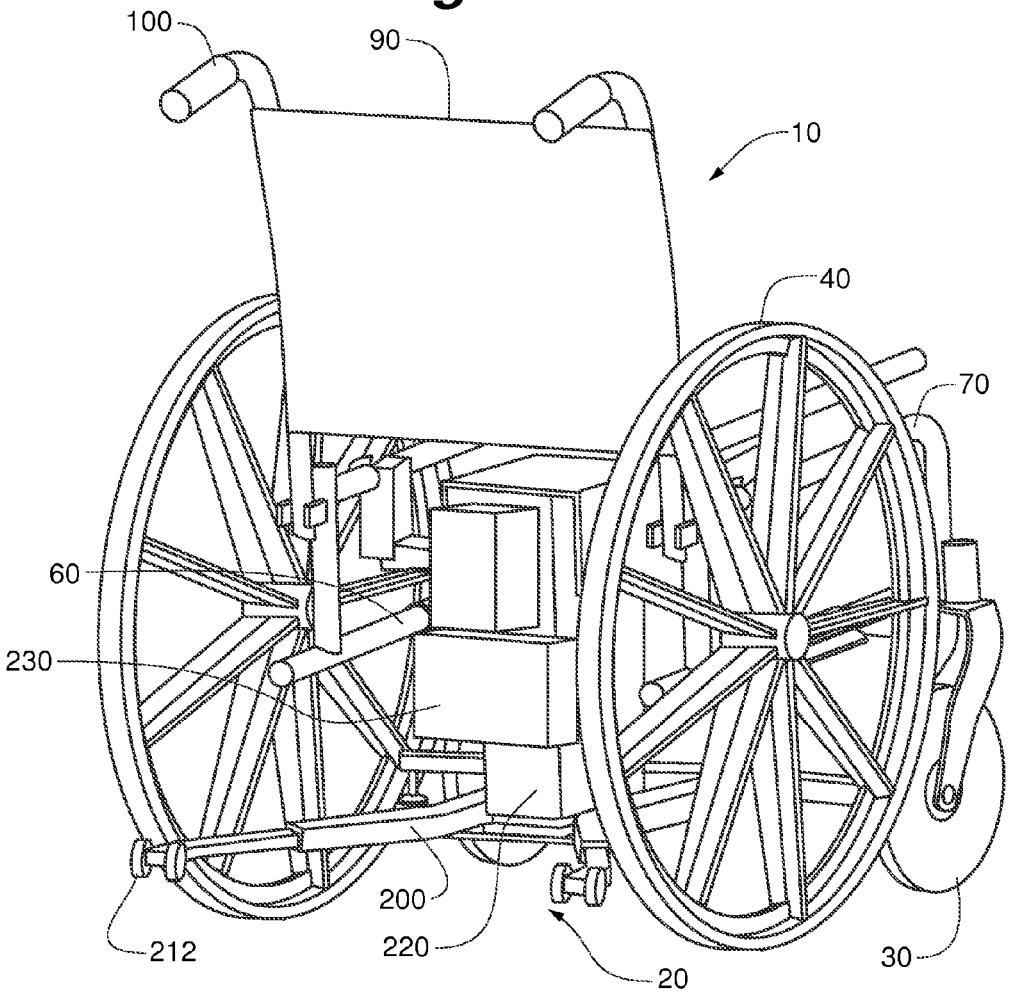
FIG. 13 shows a rear perspective view of a wheelchair and a second embodiment of a lift system in a sitting position in accordance with an embodiment of the invention.
Figure 14:
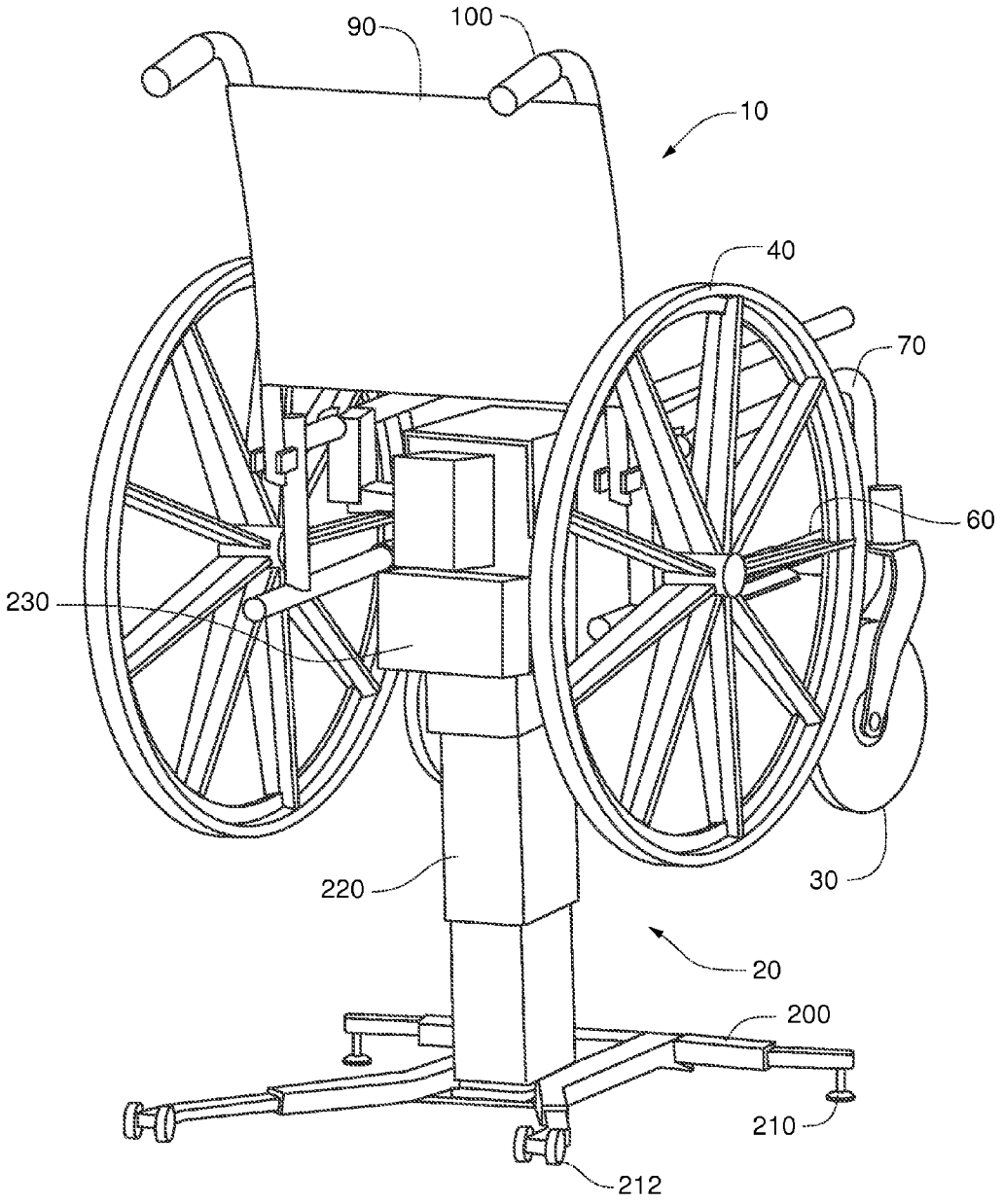
FIG. 14 shows a rear perspective view of the wheelchair and lift system of FIG. 13 in a standing position in accordance with an embodiment of the invention.
Figure 15:
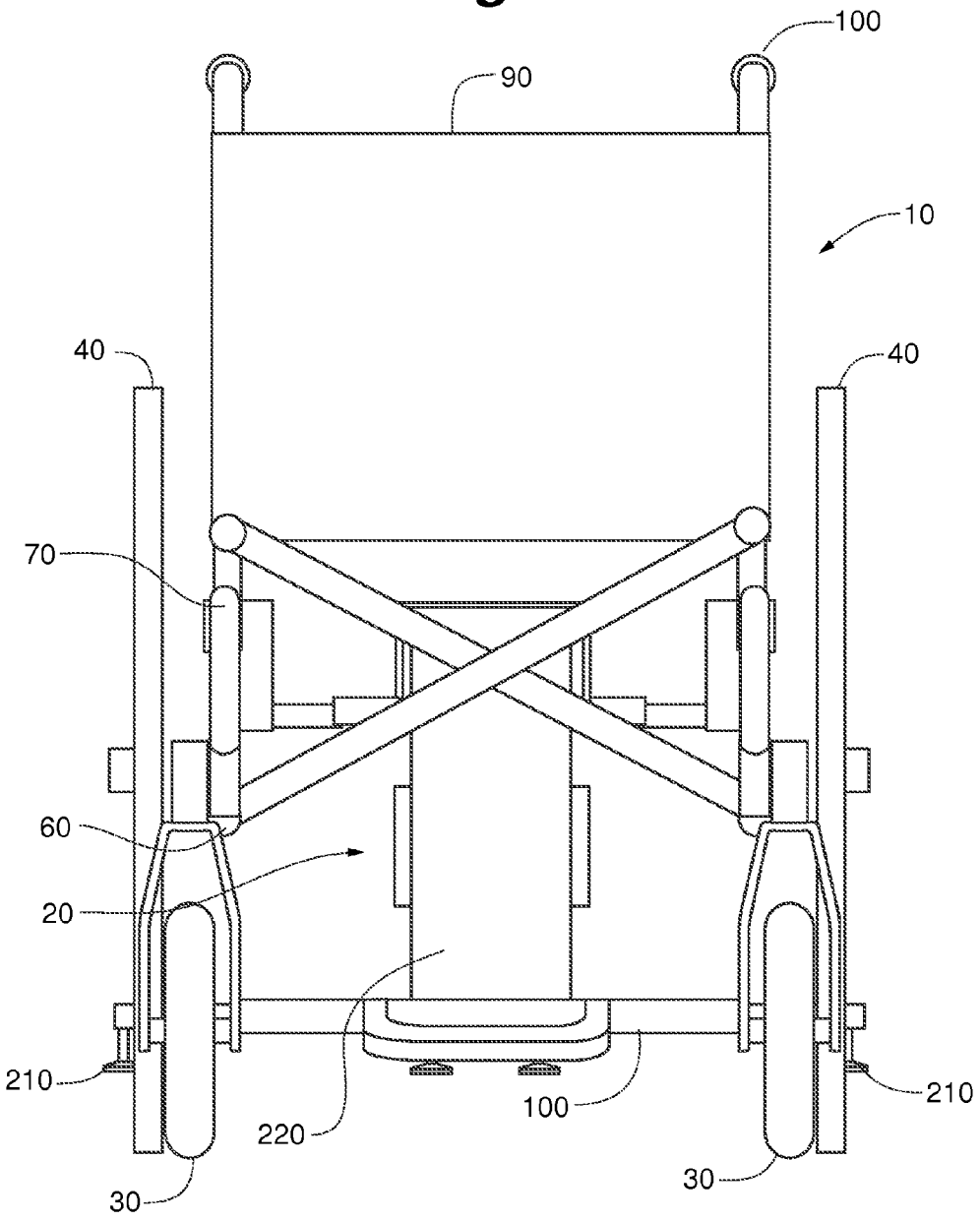
FIG. 15 shows a front plan view of a wheelchair and a second embodiment of a lift system in a sitting position in accordance with an embodiment of the invention.
Figure 16:
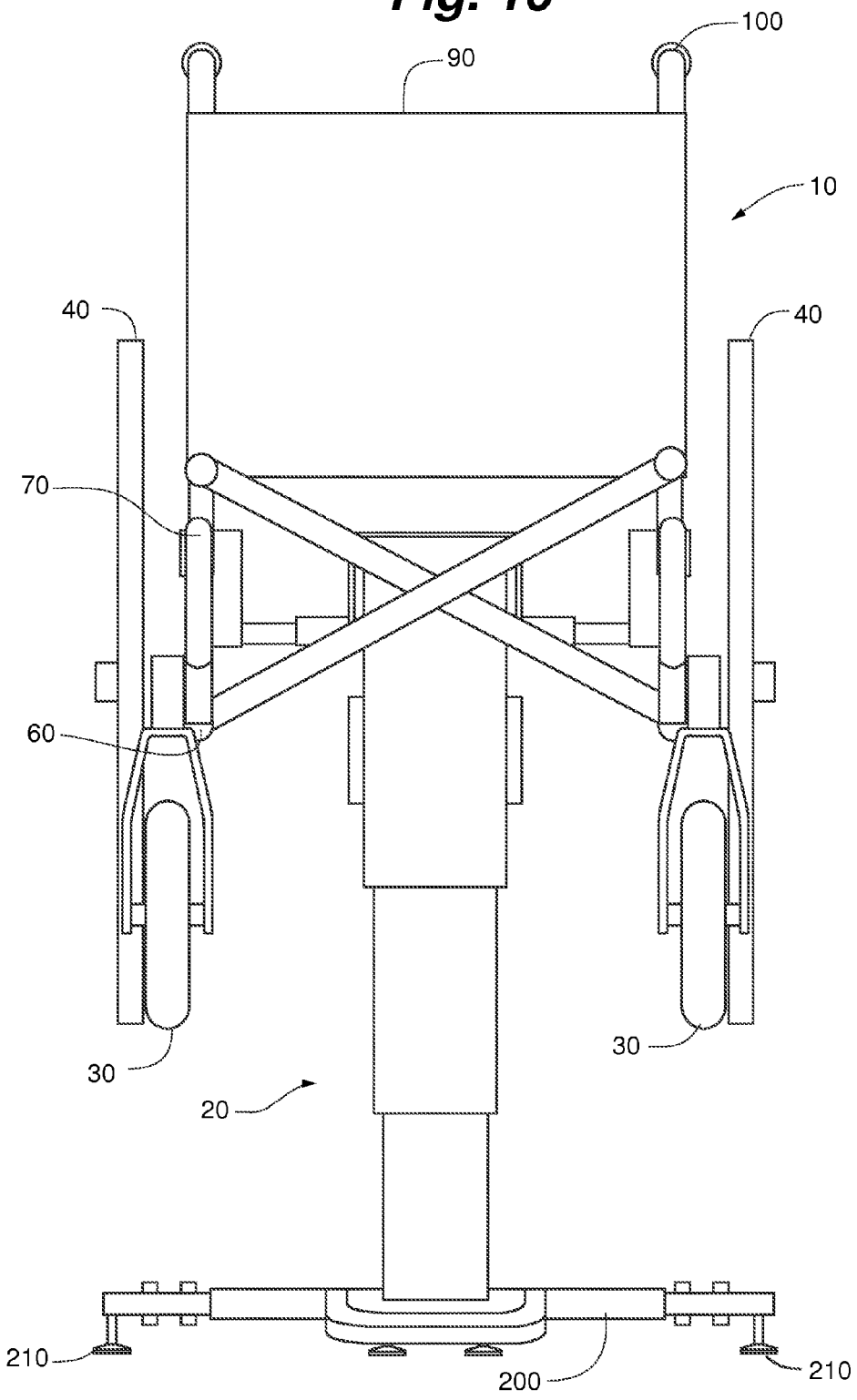
FIG. 16 shows a front plan view of the wheelchair and lift system of FIG. 15 in a standing position in accordance with an embodiment of the invention.

A second embodiment of the lift system is shown in FIGS. 11-17. The second embodiment is substantially similar to the first embodiment discussed with respect to FIGS. 1-10. FIG. 11 shows a front perspective view of a wheelchair and the second embodiment of a lift system in a sitting position, while FIG. 12 shows a front perspective view of the wheelchair and lift system of FIG. 11 in a standing position. FIG. 13 shows a rear perspective view of a wheelchair and the second embodiment of a lift system in a sitting position, while FIG. 14 shows a rear perspective view of the wheelchair and lift system of FIG. 13 in a standing position. FIG. 15 shows a front plan view of a wheelchair and the second embodiment of a lift system in a sitting position, while FIG. 16 shows a front plan view of the wheelchair and lift system of FIG. 15 in a standing position.

Figure 17:
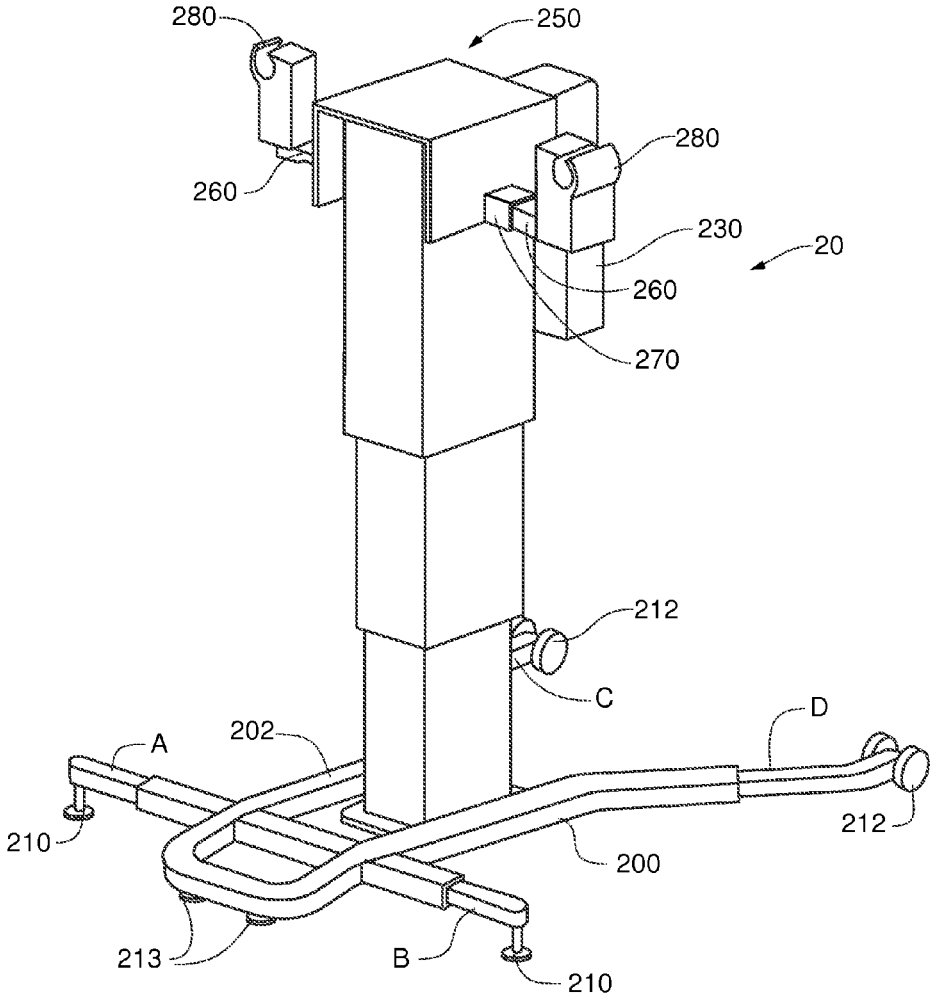
FIG. 17 shows a front perspective view of a wheelchair lift system in accordance with a second embodiment of the invention.

FIG. 17 shows a front perspective view of a wheelchair lift system in accordance with a second embodiment of the invention. As shown in FIG. 17, the second embodiment includes a support structure 200. This embodiment of the support structure 200 includes two center castors 213 for additional stability in the standing position. Further, support structure 200 includes 4 legs A, B, C, and D extending from its frame 202. As shown, each leg can be adjustably received within the frame, which allows each leg to be adjusted longitudinally (e.g., extended) with respect to the frame. Such extendable legs are useful for allowing the lift system 20 to accommodate a wide variety of wheelchair types.

Figure 17A:
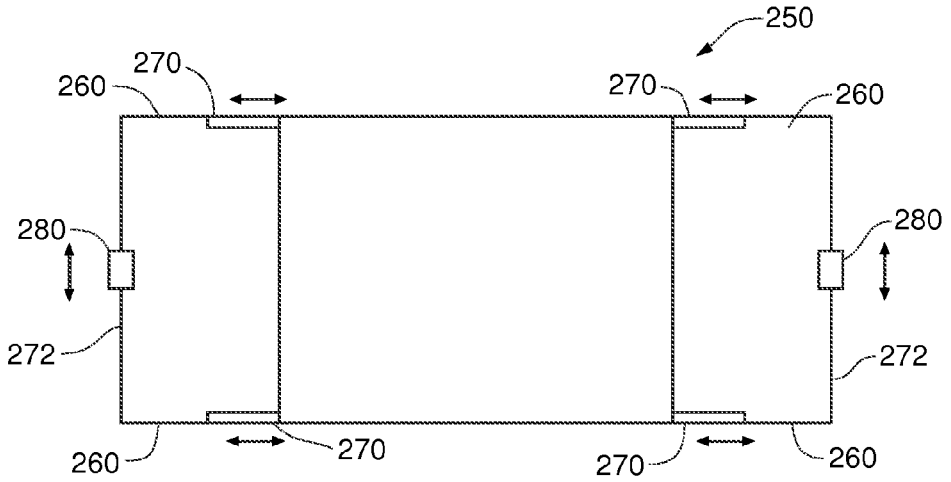
FIG. 17A shows a top plan schematic view of a universal adjustment mechanism in accordance with an embodiment of the invention.

Also as shown in FIG. 17, the second embodiment of the lift system 20 also includes a universal attachment mechanism 250, e.g., proximate the top of the vertical frame member 220. The universal attachment mechanism allows the lift system to be attached to a wide variety of existing wheelchairs. As shown, the universal attachment mechanism includes one horizontally extending members 260 received within member receivers 270 on both a left and right hand side. However, more (e.g., 2), can be provided on each side. The horizontally extending members are horizontally adjustable so as to accommodate a variety of existing wheelchair sizes and styles. In some embodiments, clamping members 280 are provided at the distal end of each horizontally extending member. As shown, the clamping members can be of a quick connect type to allow a user to quickly disconnect the lift system from a wheel chair. In certain embodiments, these clamping members are adapted to attach to an upper or lower frame rail of a wheelchair. In the embodiment shown in FIG. 17A, the clamps 280 are slidably mounted on rails 272, which allow the position of the clamp to be adjusted front to back to accommodate an even larger variety of existing wheelchair sizes and styles.

Figure 18A:
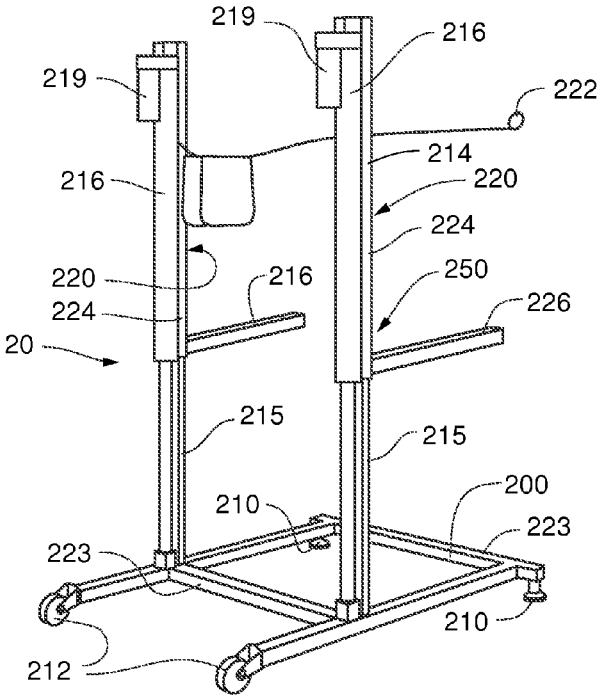
FIG. 18A shows a rear perspective view of another embodiment of a lift system in a standing position in accordance with an embodiment of the invention.
Figure 18B:
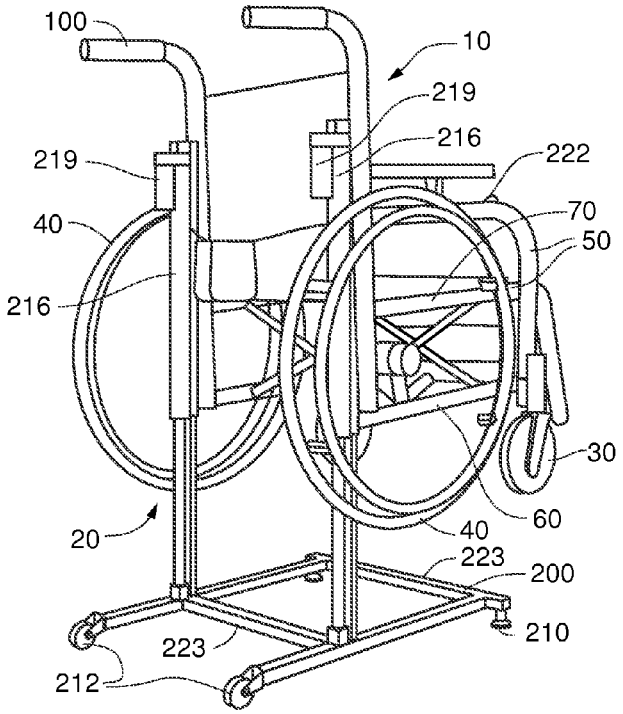
FIG. 18B shows the embodiment of the lift system of FIG. 18A attached to a wheelchair in accordance with an embodiment of the invention.
Figure 19A:
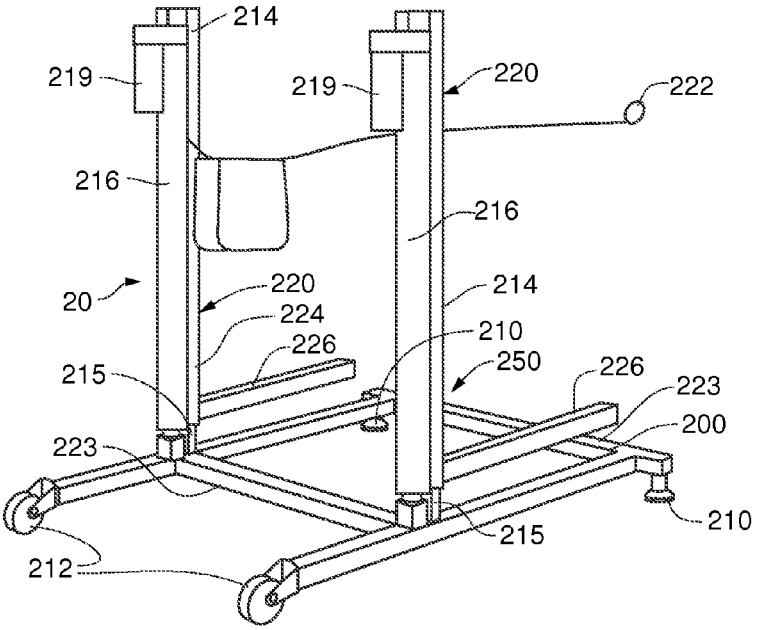
FIG. 19A shows a rear perspective view of the lift system of FIG. 19A in a sitting position in accordance with an embodiment of the invention.
Figure 19B:
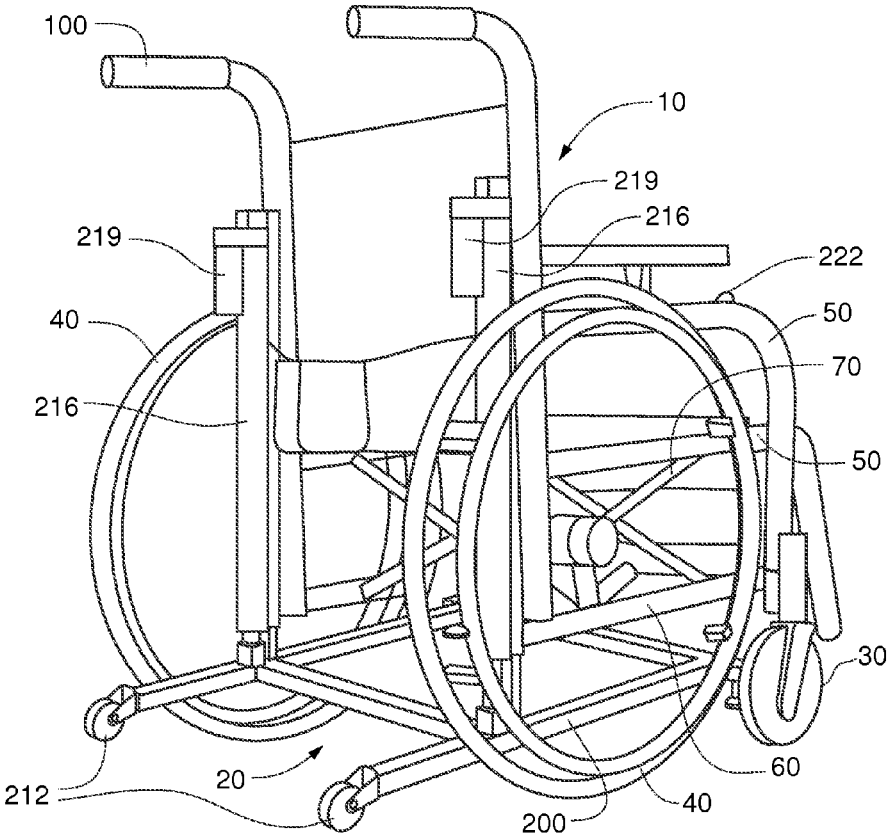
FIG. 19B shows the embodiment of the lift system of FIG. 19A attached to a wheelchair in accordance with an embodiment of the invention.

Another embodiment of the lift system 20 is shown in FIGS. 18A-19B. FIG. 18A shows the second embodiment of the lift system 20 in a standing position, and FIG. 18B shows the second embodiment of the lift system 20 in the standing position attached to a wheelchair. FIG. 19A shows the second embodiment of the lift system 20 in a sitting position, and FIG. 19B shows the second embodiment of the lift system 20 in the sitting position attached to a wheelchair. As shown, the second embodiment includes two vertical frame members 220, one each located proximate the left and right side of the wheelchair 10 when attached to the wheelchair 10. Each vertical frame member is associated with a lifting member 216 and an actuator 219. As shown, the actuator can be actuated with a switch 222, which may be positioned proximate where a user's hand would be when seated in the wheelchair. The embodiment shown in FIGS. 18A-19B also allow a wheelchair to be folded while it is attached to the lift system. To do so, horizontal members 223 can be detached.

The embodiment shown in FIGS. 18A-19B also include a universal attachment mechanism 250 for attaching the lift system to a wide variety of existing wheelchairs. As shown best in FIGS. 18A and 19A, the vertical frame member 220 (e.g., its first component 214) includes an L-shaped bracket. The generally vertical portion 224 of the L-shaped bracket is adapted to attach to a frame 50 of wheelchair 10. The generally horizontal portion 226 of the L-shaped bracket is adapted to be inserted in and received by the lower frame rail 60.

Figure 20:
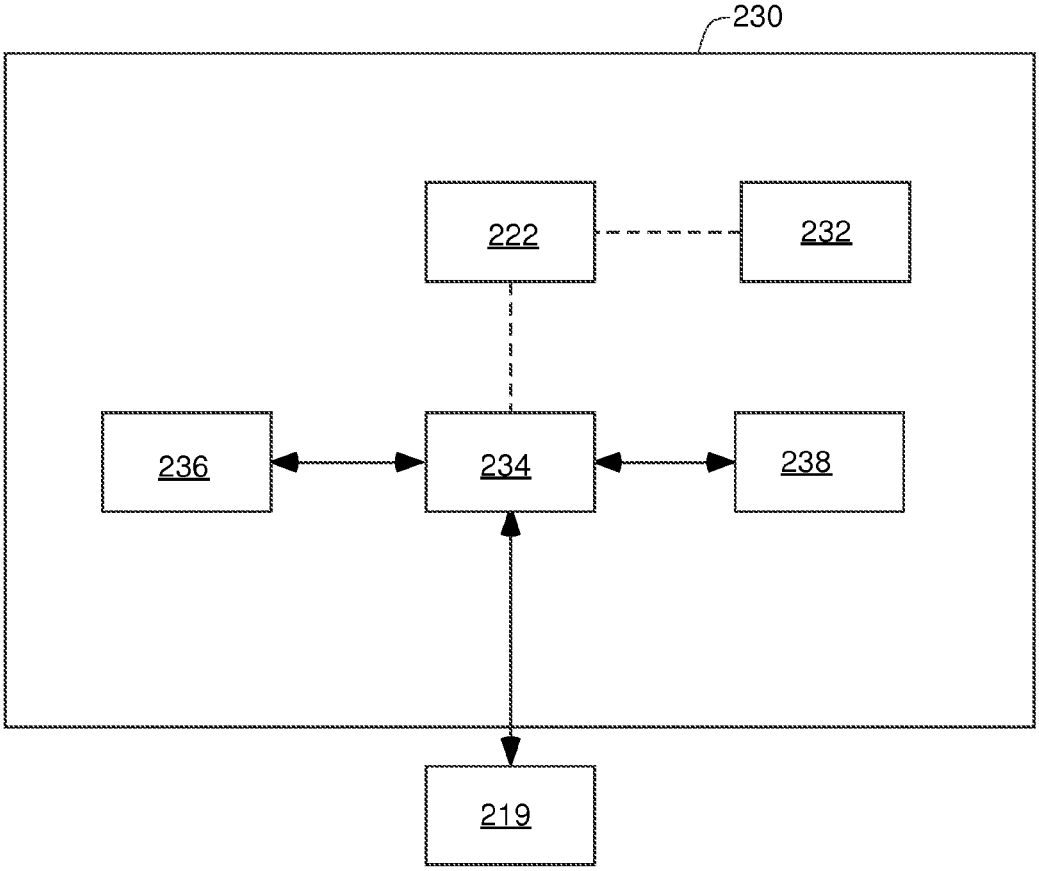
FIG. 20 shows a block diagram of a control system in accordance with an embodiment of the invention.

The lift system can also include a control system 230, as shown in FIG. 20, useful for controlling the lift system. In some embodiments, the control system includes an actuation switch 222 in signal communication with a power source 232 (e.g., a battery) in signal communication with a processor 234, which is in turn in signal communication with a memory 236 and an actuator 219. In certain embodiments, the actuation switch includes positions to raise, lower, and hold the vertical position. Optionally, the switch can also include a light to indicate its position and/or operability status. In some embodiments, the control system also includes an alarm system 238 that alerts a user that the wheelchair is unlevel. In certain embodiments, the alarm system prevents a user from increasing the height of the chair in this condition. An alarm can also be provided to indicate low battery power. In some embodiments, the control system will not allow a user to raise the height of the wheelchair unless there is enough power to raise the wheelchair to its maximum height. In such embodiments, the control system may still allow a user to lower the wheelchair position in such a condition. Additional systems and functionalities can be provided to control system, such as a USB port.

The lifting member 216 and control system 230 may be powered by any suitable power source. In some embodiments, the lift system includes a battery (e.g., 25 Volt) to power the control system and the electric motor actuator embodiments or to indirectly power pump actuator embodiments for hydraulic or pneumatic lifting member embodiments.

The control system may be packaged within a housing and mounted to any convenient location on the wheelchair or the lift system. In FIGS. 13 and 14, the control system is shown in a housing attached to the vertical member 220, and the power source (e.g., battery) is positioned above the housing such that the power source is easily accessible (e.g., for changing batteries). In some embodiments, the control system housing also houses the power source.

Embodiments of the invention also include methods of raising and lowering wheelchairs using any of wheelchair lift systems described herein. In such embodiments, the methods include one or more of the steps of actuating a wheelchair lift system to raise a wheelchair and/or actuating a wheelchair lift system to lower a wheelchair. In other embodiments, the invention includes a method of attaching and/or detaching any of the wheelchair lift systems described herein to an existing wheelchair (e.g., via a universal attachment mechanism). In such embodiments, the methods include one or more of the steps of providing a wheelchair lift system with a universal attachment mechanism and/or attaching the wheelchair lift system to an existing wheelchair (e.g., via its frame), and extending an extendable leg of a support structure.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations, which fall within the spirit and broad scope of the invention.

What is claimed is:

1. A system for lifting a wheelchair, the system comprising:

the wheelchair, the wheelchair comprising a frame having a frame rail; and a lift system, the lift system comprising:

a support frame for stably positioning the wheelchair attached to the lift system in a standing position;

a vertically extendable and retractable vertical frame member extending upward from the support frame;

a second vertically extendable and retractable frame which extends downward with respect to said first vertically extendable and retractable frame extending which extends upward a lifting member associated with the vertically extending frame member; and a universal attachment mechanism adapted to attach the vertically extendable vertical frame member to the frame of the wheelchair, the universal attachment mechanism comprising an L-shaped bracket including a generally vertical portion and a generally horizontal portion, wherein the generally horizontal portion extends horizontally out from a bottom half of the vertical frame member and is received by the frame rail of the wheelchair.

2. The system of claim 1, wherein the frame rail is a lower frame rail of a wheelchair.

3. The system of claim 1, wherein the support frame is retractable above a wheel of the wheelchair in a sitting position.

4. The system of claim 1, wherein the lift system further includes an actuator to actuate the lifting member.

5. The system of claim 4, wherein the actuator is actuated by a switch.

6. The system of claim 4, wherein the actuator is in signal communication with a control system.

7. The system of claim 1, wherein the lifting member includes a first component and a second component, the first and second components moveable with respect to each other.

8. The system of claim 1, wherein the vertically extendable vertical frame member includes a first component and a second component, the first and second components movable with respect to each other.

9. The system of claim 1, wherein the support frame includes two front castors and two rear castors.

10. The system of claim 1, wherein the lift system includes a single vertical frame member.

11. The system of claim 1, wherein the lift system includes two vertical frame members and two lifting members.

12. A method of attaching a lift system to a wheelchair, the method comprising the steps of:

providing the lift system having a support frame for stably positioning the wheelchair attached to the lift system in a standing position, a vertically extendable and retractable vertical frame member extending upward from the support frame, a lifting member associated with the vertically extending frame member, said vertically extendable and retractable vertical frame member extending upward from the support frame; a second vertically extendable and retractable frame which extends downward with respect to said first vertically extendable and retractable frame extending which extends upward, and a universal attachment mechanism comprising an L-shaped bracket including a generally vertical portion and a generally horizontal portion, wherein the generally horizontal portion extends horizontally out from a bottom half of the vertical frame member; and attaching the universal attachment mechanism to a frame of the wheelchair, wherein attaching the universal attachment mechanism to the frame of the wheelchair comprises receiving the generally horizontal portion of the L-shaped bracket at a frame rail of the frame of the wheelchair.

13. The method of claim 12, wherein receiving the generally horizontal portion of the L-shaped bracket at the frame rail comprises inserting the generally horizontal portion within a lower frame rail of the wheelchair.

14. The method of claim 12, further including the step of adjusting a length of a leg of the support frame.

15. The system of claim 1, wherein at least a portion of the generally vertical portion extends vertically out from the generally horizontal portion a distance above the generally horizontal portion.

16. The system of claim 1, wherein the generally vertical portion is adapted to attach to the frame of the wheelchair.

17. The method of claim 12, wherein the attaching step further includes attaching the generally vertical portion to the frame of the wheelchair.

* * * * *